US005795386A

United States Patent [19]

Foster et al.

[11] Patent Number: 5,795,386

[45] Date of Patent: Aug. 18, 1998

[54] APPARATUS FOR APPLYING A COATING LAYER TO A SUBSTRATE WEB

[75] Inventors: Gilbert Foster, Boxmeer; Carolus J. A. M. Schrauwers, Bergen, both of Netherlands

[73] Assignee: Stork X-Cel B.V., Boxmeer, Netherlands

[21] Appl. No.: 772,557

[22] Filed: Dec. 26, 1996

Related U.S. Application Data

[63] Continuation-in-part of Ser. No. 426,089, Apr. 21, 1995, abandoned.

[30] Foreign Application Priority Data

Apr. 22, 1994 [NL] Netherlands ..... 9400646

[51] Int. Cl.[6] ..... B05C 1/00

[52] U.S. Cl. ..... 118/203; 118/211; 118/249; 118/256; 118/261; 118/119; 118/122; 118/126

[58] Field of Search ..... 118/119, 122, 118/126, 203, 211, 249, 256, 261; 101/120

[56] References Cited

U.S. PATENT DOCUMENTS 3,511,696 5/1970 Murray ..... 427/428
3,919,973 11/1975 Zimmer ..... 101/120
4,030,410 6/1977 Zimmer ..... 101/120
4,299,164 11/1981 Jonkers ..... 101/120
4,363,833 12/1982 Blaak ..... 101/120

FOREIGN PATENT DOCUMENTS 0095819 12/1983 European Pat. Off. .

*Primary Examiner*—Laura Edwards
*Attorney, Agent, or Firm*—Brooks & Kushman P.C.

[57] ABSTRACT

A device for applying a coating layer to a substrate web comprises an application roll for applying the coating layer to the substrate web, a counterpressure roll interacting with the application roll in order to support a substrate web passing through between the application roll and the counterpressure roll, the application roll being designed to rotate in the same direction as the counterpressure roll, so that at the position of the counterpressure roll the direction of movement of the periphery of the application roll is opposite to that of the counterpressure roll, and a metering device for applying a coating material in a layer to the application roll, which metering device comprises a rotating cylindrical screen and a squeegee disposed inside the cylindrical screen.

10 Claims, 1 Drawing Sheet

APPARATUS FOR APPLYING A COATING LAYER TO A SUBSTRATE WEB

This is a continuation-in-part of application Ser. No. 08/426,089 filed on Apr. 12, 1995 now abandoned.

BACKGROUND OF THE INVENTION

The invention relates to a device for applying a coating layer to a substrate web, comprising an application roll for applying the coating layer to the substrate web, a counterpressure roll interacting with the application roll in order to support a substrate web passing through between the application roll and the counterpressure roll, and a metering device for applying a coating material in a layer to the application roll, the application roll being designed to rotate in the same direction as the counterpressure roll, so that at the position of the counterpressure roll the direction of movement of the periphery of the application roll is opposite to that of the counterpressure roll.

Such devices are known and are called reverse-roll coaters. Two types of devices can be distinguished here, depending on the type of metering device which is used.

In the case of the first type the metering device consists of a metering roll which interacts with the application roll. The metering roll runs through a bath of the coating material and takes up this material in the process. The material taken up is then transferred to the application roll. This type of device is suitable in particular for applying coating materials of relatively low viscosity. The disadvantage of the device is that the quantity of coating material taken up from the bath cannot be regulated well. Additional measures are necessary to regulate the quantity of coating material on the application roll, for example using a scraper knife.

In the case of another type of device, which is more suitable for high-viscosity coating materials, the metering device also consists of a metering roll interacting with the application roll. Said metering device is situated a short distance away from the application roll. The relatively highly viscous coating material lies in the channel formed by the metering roll and application roll, and is taken up through the gap between the application roll and the metering roll. The disadvantage of this type of device is that the quantity of coating material on the application roll depends on the distance between the metering roll and the application roll. When substrate webs of great width (for example, 3 to 4 meters) are being coated, the accuracy and the stability of the metering roll and application roll need to be high over the full width in order to obtain a uniform thickness of coating layer.

SUMMARY OF THE INVENTION

The object of the invention is to provide a device for the application of a coating layer to a substrate web, in which the disadvantages of the known devices are overcome.

This object is achieved by a device for applying a coating layer to a substrate web, comprising an application roll for applying the coating layer to the substrate web, a counterpressure roll interacting with the application roll in order to support a substrate web passing through between the application roll and the counterpressure roll, and a metering device for applying a coating material in a layer to the application roll. The application roll is designed to rotate in the same direction as the counterpressure roll, so that at the position of the counterpressure roll the direction of movement of the periphery of the application roll is opposite to that of the counterpressure roll, wherein the metering device comprises a rotating cylindrical screen and supply means for supplying the coating material.

With the device according to the invention it is possible to regulate the thickness of the coating layer within very narrow limits, so that very low layer thicknesses, corresponding to a quantity of coating material of 5–6 grammes per $m^2$ can be achieved. The thickness of the coating layer can be regulated easily by the choice of type of screen and the speed of the application roll relative to the counterpressure roll.

Preferred embodiments of the device according to the invention are laid down in the dependent claims.

The invention is explained in greater detail in the following description with reference to the drawings.

DETAILED DESCRIPTION OF PREFERRED EMBODIMENTS

Figure 1:
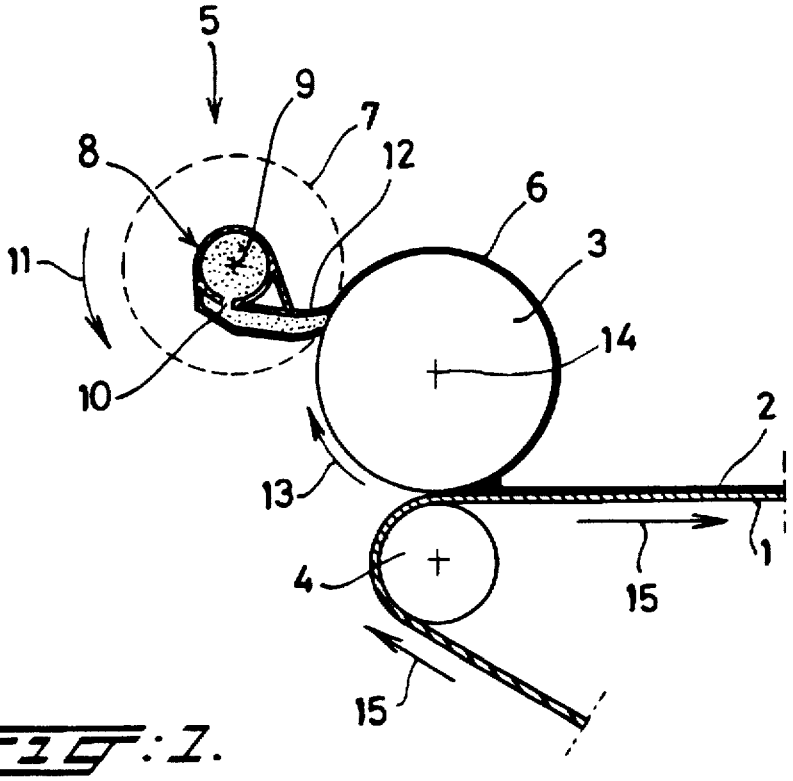
FIG. 1 shows diagrammatically the layout of a device according to the invention.

FIG. 1 shows diagrammatically the layout of a device for applying the coating layer to a substrate web. In FIG. 1 the substrate web is indicated by the reference number 1 and the coating layer by the reference number 2. The device comprises an application roll 3 for applying the coating layer 2 to the substrate web 1, a counterpressure roll 4 interacting with the application roll 3 in order to support the substrate web 1 passing through between the application roll 3 and the counterpressure roll 4, and also a metering device 5 for applying the coating material in a layer 6 to the application roll 3.

The metering device 5 consists of a rotating cylindrical screen 7 and a squeegee 8, preferably of the closed type, disposed inside the screen. However, other types of squeegees, such as open-type squeegees, roller squeegees etc., can also be used.

The device operates as follows. The coating material 9 is supplied through the inside of the squeegee 8. The coating material 9 flows through a gap 10, extending in the lengthwise direction of the squeegee 8, into the inside of the cylindrical screen 7. The screen 7 rotates in the direction of the arrow 11. At the position of a flexible squeegee blade 12, the coating material is forced through the screen and thus applied in a layer 6 to the outside of the application roll 3, which rotates in the direction of the arrow 13. The free edge of the squeegee blade 12 preferably lies in the plane through the axis of the rotating screen 7 and the axis 14 of the application roll 3. Very good metering of the coating material can be achieved in this way.

The coating material is then applied by the application roll 3 to the substrate web 1, which is passed around the counterpressure roll 4 and runs through between the application roll 3 and the counterpressure roll 4 in the direction of the arrows 15. This means that at the position of the substrate web 1 the directions of movement of the application roll 3 and the substrate web 1 are opposite to each other. Such a type of device is therefore often known as a reverse-roll coater.

The application roll 3, at least at the periphery, is made of a shape-retaining (hard) material, i.e. a material which is shape-retaining under the loads occurring upon the roll. The shape-retaining material used is, for example, metal or ceramic material.

The counterpressure roll 4, at least at the periphery, is made of a resilient material, i.e. a material which can eliminate slight unevennesses in the substrate web to be coated and slight deviations in the parallelism of the application roll 3 and the counterpressure roll 4. Moreover, the coefficient of friction of the resilient material of the counterpressure roll 4 should be greater than that of the shape-retaining material of the application roll 3, so that the substrate web to be coated is conveyed by the counterpressure roll 4. The resilient material used is, for example, rubber.

The gap between the application roll 3 and the counterpressure roll 4 is such that a substrate web 1 passing between the application roll and the counterpressure roll is continuously drawn along the surface of the application roll. This gap may be varied from just less than the thickness of the web 1 to equality with such thickness.

The gap between the application roll 3 and the counterpressure roll 4 is preferably slightly smaller than the thickness of the substrate web to be coated.

The thickness of the coating layer 2 can be regulated by means of three parameters: the type of screen (mesh, thickness and open area), the squeegee pressure and the speed of the application roll 3 relative to the counterpressure roll 4, and thus the substrate web 1. A low weight of coating material can be applied to the application roll 3 by selecting a screen with a high mesh number (many holes), in conjunction with a low wall thickness and a relatively small open area. The reverse applies to a screen with a low mesh number (fewer holes), a greater wall thickness and a large open area. In this case the squeegee pressure, i.e. the pressure of the squeegee blade 12 against the screen 7 also plays a role.

The thickness of the coating layer 2 can also be regulated by regulating the speed of the application roll 3 relative to the speed of the substrate web 1. The higher the speed of the application roll 3 relative to the speed of the substrate web 1, the thicker will be the coating layer 2.

The advantages of the device according to the invention are:

- very suitable for applying coating layers with a low weight per $m^2$,
- suitable for applying coating materials of differing viscosity (low and high viscosity),
- virtually no penetration of the coating material into the substrate web,
- relatively simple and cheap, particularly for greater widths,
- rolls not susceptible to damage,
- changing coating material is simple,
- capacity of the system is relatively small,
- can also be used for printing (direct or indirect),
- suitable for the application of foamed coating materials (with foam squeegee).

The specific advantages of the device according to the invention over the known devices (reverse-roll coaters) for the production of waterproof and breathing coating layers are:

- very suitable for applying coating layers with a low weight per $m^2$ (approx. 5–6 grammes per $m^2$), while the textile properties of the substrate are retained,
- constant and regulable layer thicknesses, the regulation being through selection of the screen, squeegee pressure and speed of the application roll (less waste and high reproducibility).

It is pointed out that the device according to the invention can also be used more generally, for example for direct screen printing and indirect screen printing.

Figure 2:
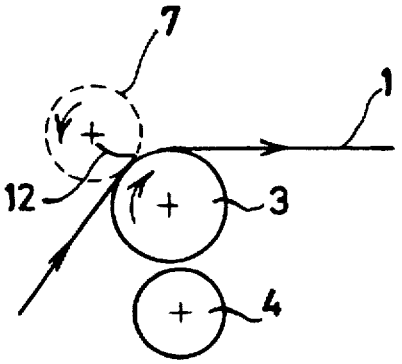
FIGS. 2 and 3 show diagrammatically other applications of the device according to the invention.

In the case of the first-mentioned application, direct screen printing, the substrate web 1 is passed through between the rotating screen 7 and the application roll 3, as shown diagrammatically in FIG. 2, and a pattern is printed on the substrate web.

Figure 3:
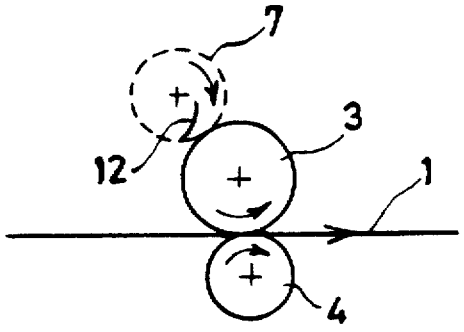

In the case of the second application, indirect screen printing, which is shown diagrammatically in FIG. 3, as in the case of the device of FIG. 1, the substrate web 1 is passed through between the application roll 3 and the counterpressure roll 4. However, in the case of this application, the application roll 3 is used to transfer to the substrate web 1 a pattern which has been forced through the screen onto the application roll. The application roll 3 in this case rotates in a direction opposite to the direction of rotation of the application roll 3 shown in FIG. 1. At the position of the substrate web 1, the direction of movement of the application roll 3 is the same as that of the substrate web 1, and the direction of rotation of the cylindrical screen 7 is reversed.

In the case of the last-mentioned application, indirect screen printing, the diameter of the cylindrical screen 7 is preferably the same as the diameter of the application roll 3, and provision is made for drive means by which the cylindrical screen 7 and the application roll 3 can be driven in such a way that they rotate at the same peripheral speed, but in opposite directions of rotation.

The device according to the invention is therefore such that it can be used for several purposes, possibly with minor adjustments.

What is claimed is:

1. A device for applying a coating layer to a substrate web, comprising, in combination:

an application roll for applying the coating layer to the substrate web;

a counterpressure roll interacting with the application roll in order to support a substrate web passing between the application roll and the counterpressure roll;

a metering device for applying the coating material in a layer to the application roll;

said metering device being in fluid communication with the application roll and having a cylindrical screen rotating about its axis with supply means for supplying the coating material to the cylindrical screen;

said application and counterpressure rolls being spaced apart to provide at their peripheries a gap therebetween having a width such that a substrate web passing between the application roll and the counterpressure roll is continuously drawn along the surface of the application roll; and said application roll rotating about its axis in the same direction as the counterpressure roll so that at said gap the periphery of the application roll moves in a direction opposite to that of the periphery of the counterpressure roll.

2. The device of claim 1, wherein the supply means comprise a squeegee disposed inside the cylindrical screen.

3. The device of claim 2, wherein the squeegee is a closed squeegee.

4. The device of claim 2 wherein the squeegee comprises a squeegee blade with a free edge cooperating with the cylindrical screen and the free edge of the squeegee blade of the squeegee lies essentially in the plane in which the axes of rotation of the cylindrical screen and the application roll are situated.

5. The device of claim 1, wherein the application roll, at least at the periphery, is made of a shape-retaining material.

6. The device of claim 1, wherein the counterpressure roll, at least at the periphery, is made of a resilient material.

7. The device of claim 1, wherein a gap is present between the application roll and the counterpressure roll, said gap being slightly smaller than the thickness of the substrate web to be coated.

8. The device of claim 1, wherein the diameter of the cylindrical screen is the same as the diameter of the application roll, and wherein provision is made for drive means, by which the cylindrical screen and the application roll can be driven in such a way that they rotate at the same peripheral speed, but in opposite directions of rotation.

9. The device as set forth in claim 1, wherein the substrate web is fed between the cylindrical screen and the application roll.

10. A device for applying a coating layer to a substrate web, comprising, in combination:

an application roll for applying the coating layer to the substrate web;

a counterpressure roll interacting with the application roll in order to support a substrate web passing between the application roll and the counterpressure roll;

a metering device for applying the coating material in a layer to the application roll;

said metering device being in fluid communication with the application roll and having a cylindrical screen rotating about its axis with supply means for supplying the coating material to the cylindrical screen;

said application and counterpressure rolls being spaced apart to provide at their peripheries a gap therebetween; and said application roll rotating about its axis in the same direction as the counterpressure roll so that at said gap the periphery of the application roll moves in a direction opposite to that of the periphery of the counterpressure roll.

* * * * *